United States Patent [19]

Jordon

[11] Patent Number: 4,793,732

[45] Date of Patent: Dec. 27, 1988

[54] PAVEMENT SLOT CUTTER

[76] Inventor: Robert L. Jordon, P.O. Box 273, Elk Grove, Calif. 95624

[21] Appl. No.: 146,656

[22] Filed: Jan. 21, 1988

[51] Int. Cl.[4] ..... E01C 23/12

[52] U.S. Cl. ..... 404/90; 299/37; 299/39; 299/85; 37/DIG. 3

[58] Field of Search ..... 404/90–92, 404/121, 122, 124; 299/36–40, 85, 87, 91, 89; 37/117.5, DIG. 3, DIG. 12

[56] References Cited

U.S. PATENT DOCUMENTS

| | | | |
|---|---|---|---|
| D. 274,525 | 7/1984 | Jordan | D15/32 |
| 3,279,856 | 10/1966 | Silks | 299/85 |
| 4,662,684 | 5/1987 | Marten | 299/39 X |

FOREIGN PATENT DOCUMENTS

| | | | |
|---|---|---|---|
| 96585 | 12/1983 | European Pat. Off. | 404/90 |
| 870564 | 10/1981 | U.S.S.R. | 404/124 |
| 875051 | 10/1981 | U.S.S.R. | 299/85 |

*Primary Examiner*—Stephen J. Novosad
*Assistant Examiner*—John F. Letchford
*Attorney, Agent, or Firm*—Lothrop & West

[57] ABSTRACT

A pavement slot cutter has a mobile support adapted to advance on the pavement in a predetermined direction. A drum is mounted on the support to rotate about a horizontal, transverse axis. A motor within a hub fast on the support rotates the drums. A transversely extending casing on the drum holds a transversely extending tooth structure for reciprocation therein toward and away from the support. An undulatory cam track is formed in the hub and is engaged by a cam follower on the tooth.

8 Claims, 5 Drawing Sheets

PAVEMENT SLOT CUTTER

BACKGROUND OF THE INVENTION

Field Of The Invention

The device is in the field of devices for cutting a channel or trench through a hard surface material.

SUMMARY OF THE INVENTION

A rotary drum mounted on a mobile support carries teeth mounted to move transversely on the drum parallel to the axis of rotation of the drum. A coaxial, stationary hub inside the drum has a cam varied in axial location. A tooth structure is mounted on the drum for reciprocatory movement parallel to the axis. A cam follower on the tooth structure engages the cam.

DESCRIPTION OF THE PREFERRED EMBODIMENT

Figure 1:
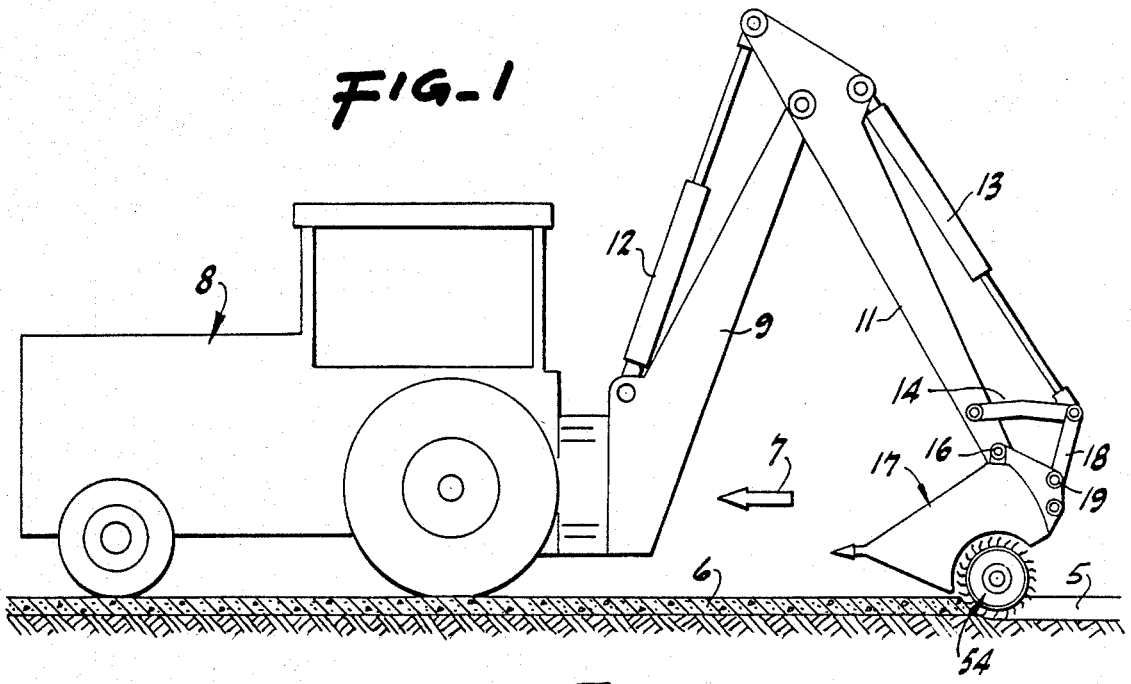
FIG. 1 is a partly diagrammatic side elevation of a structure incorporating the pavement slot cutter of the invention.

The structure can be used in various different environments to provide a ditch 5 or trench but is especially intended for use on or in a hard surface such as a concrete roadway 6, macadam, or oil and gravel layer, or even hard surface ground. Advancing in the direction 7 is a tractor 8, for the most part of standard construction and having a mast 9 on which is mounted a boom for pivotal swinging under control of a hydraulic jack 12. A similar hydraulic jack 13 is effective to pivot a yoke 14 on the boom 11. Connected to the boom 11 by a pivot 16 is a bucket 17. A link 18 is pivotally joined to the yoke 14 and to the bucket 17 by a pin 19.

The bucket 17, while largely similar to the usual backhoe bucket, is specially adapted for this device. A sturdy central septum or mounting wall 20 spans the lower portion of the bucket in a vertical, fore and aft direction (the direction 7). The side portions of the bucket are contoured by arcuate walls 21 or shields joining the septum and partially defining oppositely facing lateral recesses.

Figure 5:
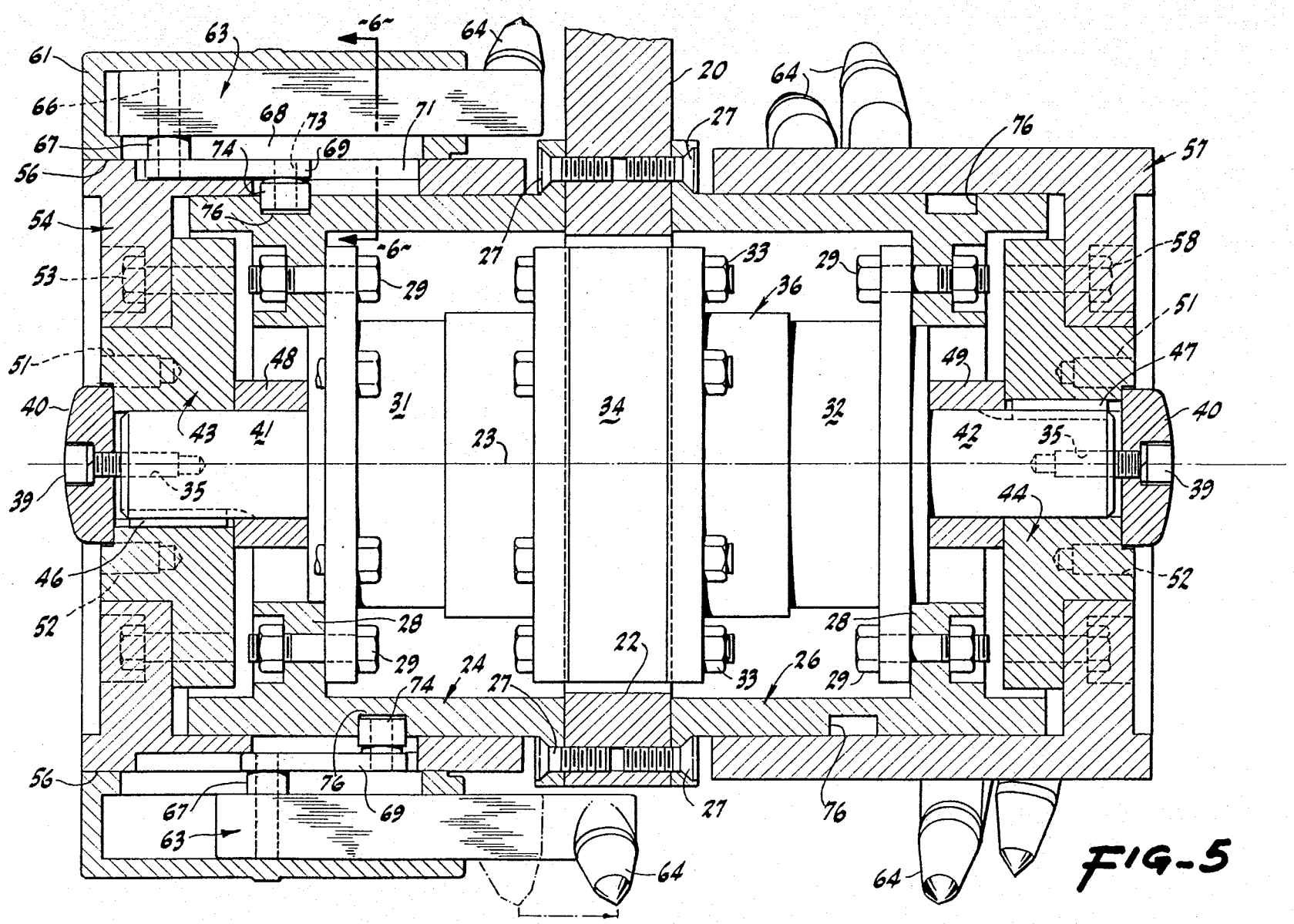
FIG. 5 is a cross-section of a complete drum structure and some of its adjacent mounting, the dihedral planes of section being on the lines 5—5 of FIG. 3.

As especially shown in FIG. 5, the septum 20 has a central aperture 22 generally circular about an axis 23 disposed in a horizontal plane and extending at right angles or normal to the direction 7 of advance. Secured to opposite sides of the septum 20 are similar, cup-like hubs or extensions 24 and 26 removably held in alignment on the axis 23 by screws 27. Since the hubs 24 and 26 are virtually identical, a description of one applies to the other.

An internal flange 28 on each hub has fastenings 29 removably positioning drive housings 31 and 32 in coaxial position. The housings in turn are joined by fasteners 33 to the central housing 34 of a hydraulic drive motor 36. This is not shown in detail but in practice is usually a vane motor or a gear motor receiving and discharging propulsion fluid through ducts 37 and 38 from a suitably controlled standard source, not shown, but capable of operating the motor 36 in at least one direction at the desired relatively high speed. Appropriate bearings, not shown, in the housings 31 and 32 support drive shafts 41 and 42 coupled to the motor 36 for rotation about the axis 23. Hubs 43 and 44 are secured to the respective shafts 41 and 42 by keys 46 and 47 and are axially positioned by sleeves 48 and 49. Preferably the hubs 43 and 44 are force fitted on their respective shafts and have threaded holes 51 and 52 to permit the use of a standard form of puller (not shown) for removal. Additional holding effort is afforded by a pair of washers 40 retained by bolts 39 engaging axial threaded bores 35 in the shafts 41 and 42.

Seated on the hub 43 and secured by studs and nuts 53 is a carrier 54 concentric with the axis 23 and rotatable with the shaft 41. The carrier is generally circular-cylindrical in exterior contour but is provided with one or more (in this case, three) flats 56 equally spaced about the periphery. Comparably, the hub 44 is flanged to receive concentrically a carrier 57 secured by studs and nuts 58 and has a plurality (three) of equally spaced, axially extending peripheral flats 59. The flats 59 are sometimes staggered with respect to the flats 56.

Figure 4:
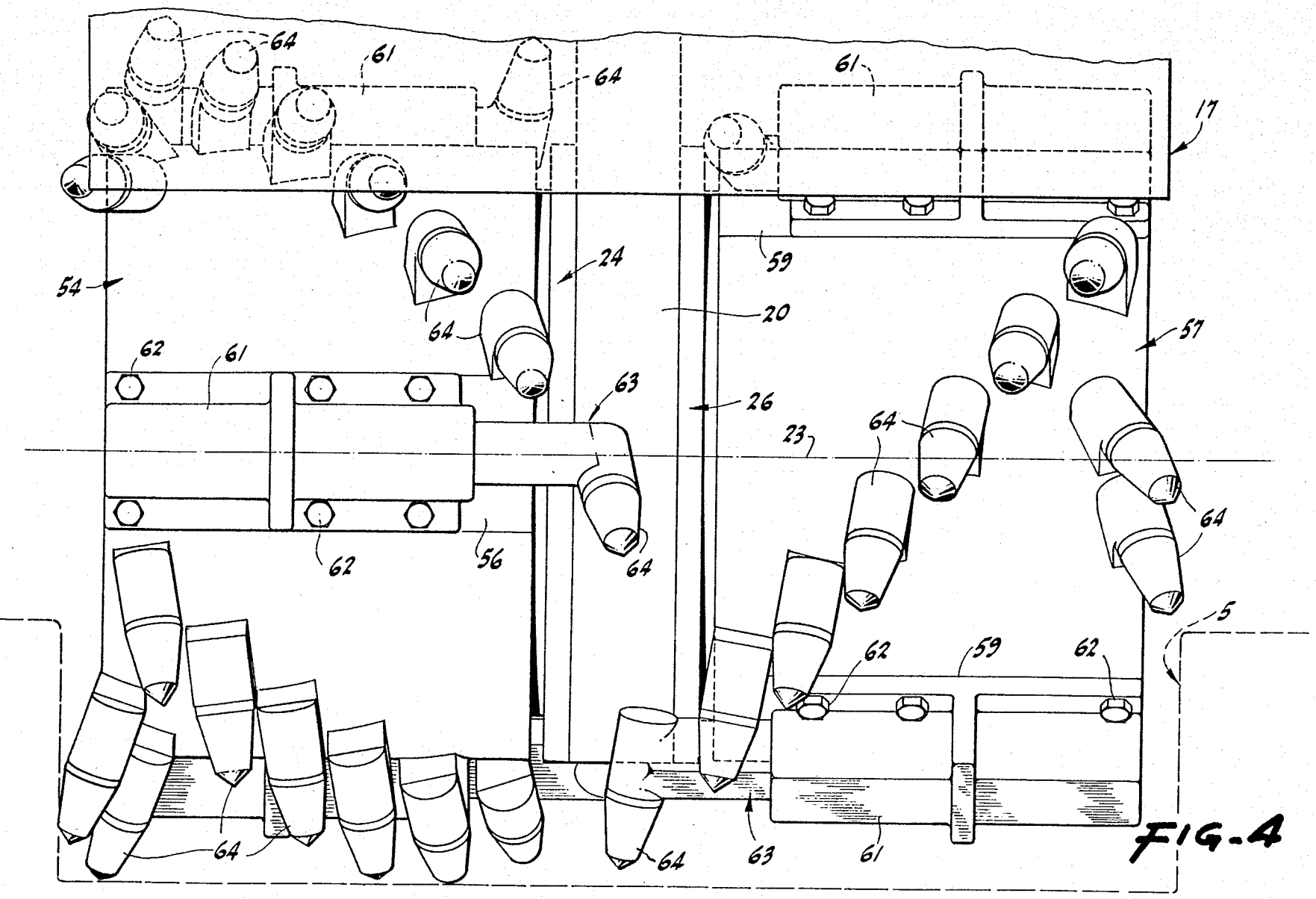
FIG. 4 is a front elevation of the drum structure of FIG. 3, the upper portion of the figure being broken away.

Each one of the flats 56 and 59 receives a removable jacket 61 held by fasteners 62. Each jacket is preferably square in cross-section, closed at one end, and open at the other end to encase a reciprocable tooth carrier 63 also of square cross-section and extending axially through the open end of the jacket 61. The exposed end of the tooth carrier 63 supports a removable tooth 64 comparable to numerous other teeth 64 stationarily mounted on and about the exterior of each carrier 54 in desired locations, as shown in FIG. 4.

Figure 7:
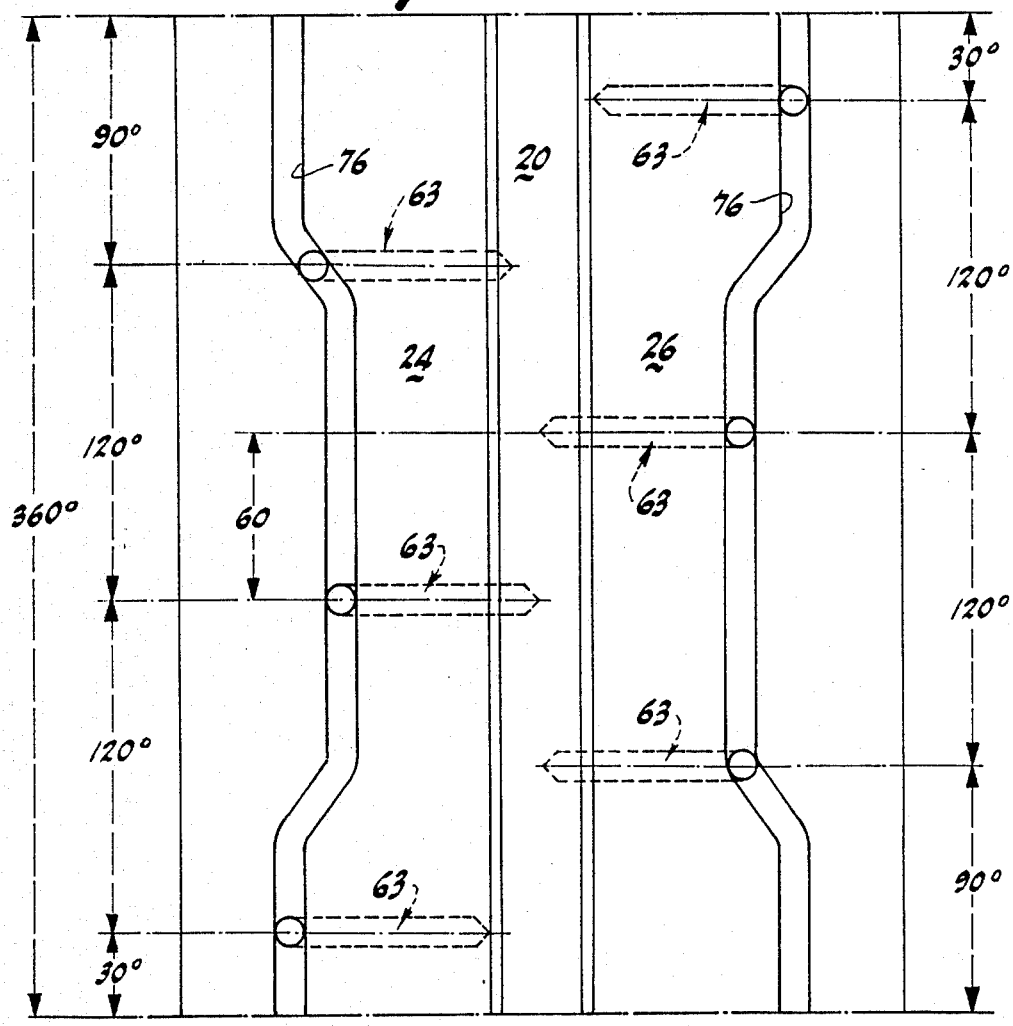
FIG. 7 is development partly diagrammatic of the cam structure of the drums.
Figures 2, 6:
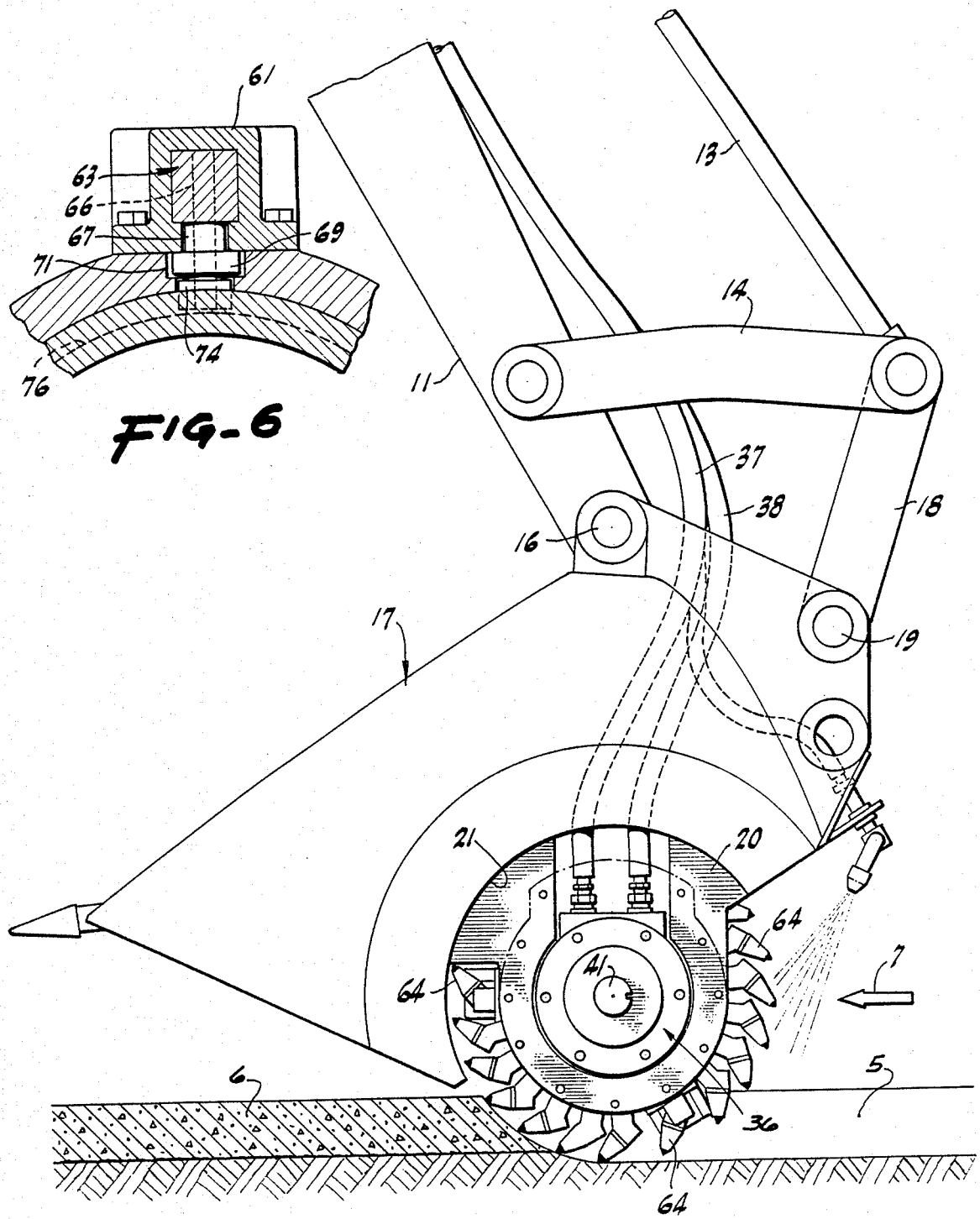
FIG. 2 is a side elevation of a portion of the slot cutting mechanism itself, the near side drum being removed.
FIG. 6 is a detail cross-section, the plane of which is indicated by the line 6—6 of FIG. 5.
Figure 3:
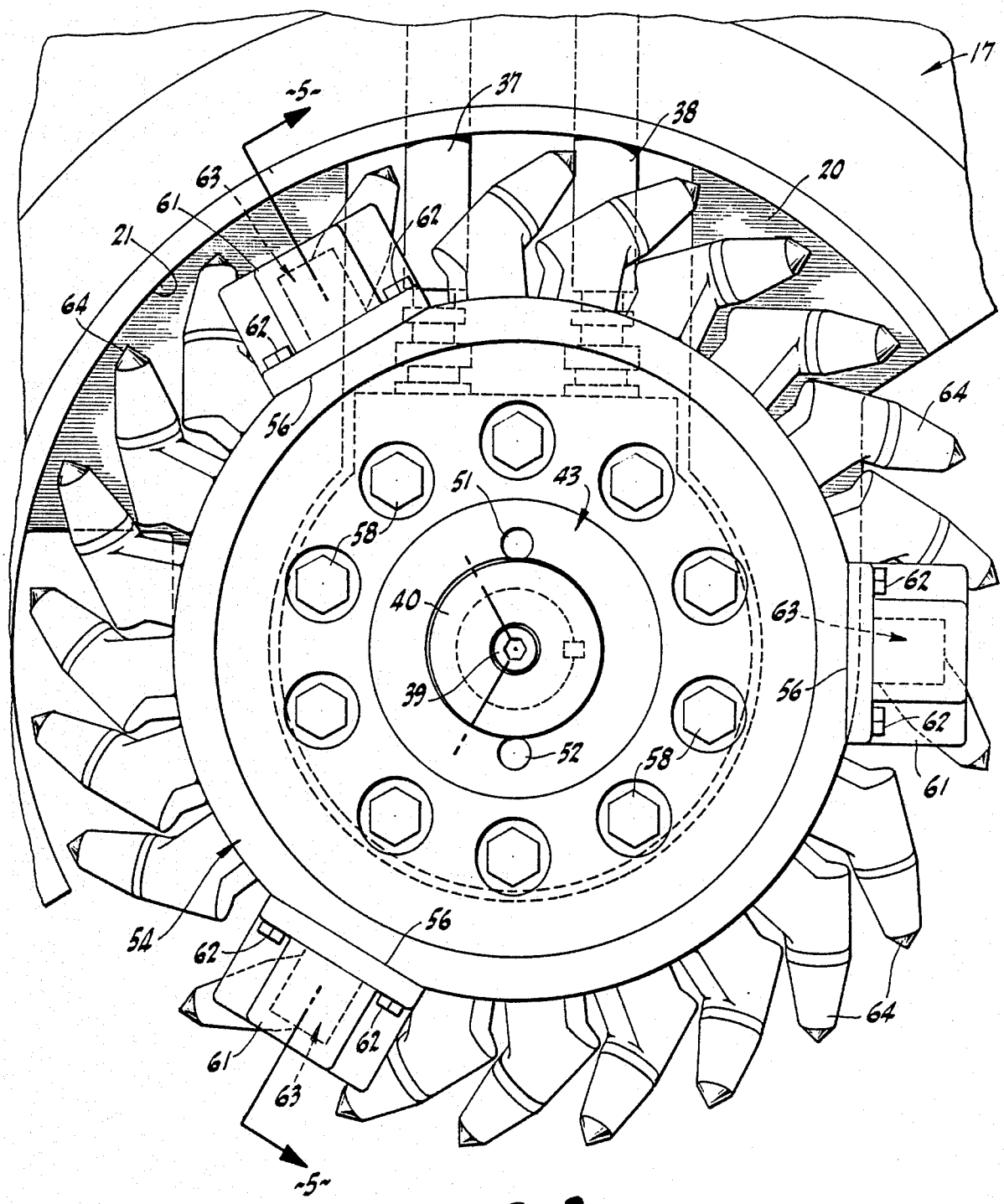
FIG. 3 is a view to a greatly enlarged scale of a drum structure in side elevation.

The reciprocable teeth carriers in the jackets 61 are provided with special reciprocating mechanism. Each carrier 63 has a driving pin 66 extending therefrom through a spacer 67 reciprocable within an axial slot 68 in the jacket. Also on the pin 66 is a link 69 recriprocably disposed in a wide slot 71 in the carrier 54. This, in turn, opens into a narrow slot 72 receiving a pin 73 journalling a roller 74 partially extending into a peripheral cam groove 76 (FIG. 7) describing a sinuous path about the outside of the flange 28. Each cam groove has a configuraion to reciprocate the responsive tooth carrier 63 in a path so that the carried tooth 64 is kept well away from the septum 20 as the tooth rotates past the septum but is well projected or advanced at least to the center plane or a little past the center plane when away from the vicinity of the septum.

In the operation of this device, the motor 36 is started so that the tooth carriers are rotated about the axis 23 and so that the movable teeth are also transversely reciprocated toward and away from the center plane, preferably with a small overlap. The hydraulic jacks 12 and 13 (FIG. 1) are then activated to move the rotary carriers 54 from a position above that of the pavement 6 into a position engaging the pavement. An initial cut is thus taken. Thereafter the boom 11 is swung and the tractor 8 is advanced in the direction 7 so that the cutting teeth progressively cut or break away the pavement material, so forming an exposed trench or ditch and generating some spoil or debris. The hydraulic controls can be operated from time to time to remove the rotors from the ditch and to use the bucket 17 to remove the accumulated soil and deposit it to one side. During the operation of the rotors, the bucket acts as a shield to prevent dislodged ditch material from flying about, perhaps destructively. The bucket is slightly narrower than the overall width of the combined rotors so that the rotors are freely able to cut proper ditch sides.

I claim:

1. A pavement slot cutter comprising a support, a boom on said support and extending therefrom in a predetermined direction, a drum having an end, means for mounting said drum on said boom for rotation relative thereto about a horizontal axis extending normal to said predetermined direction, a mobile tooth, means for mounting said mobile tooth on said drum for rotation with said drum and for reciprocating said mobile tooth in a path between a projected position beyond said end of said drum and a retracted position proximate said end of said drum.

2. A device as in claim 1 including a cylinder attached to said boom and disposed within said drum, means defining a sinuous cam fixed around the periphery of said cylinder, and a cam follower mounted on said mobile tooth and engaging said cam.

3. A device as in claim 1 in which said means for reciprocating said mobile tooth effects at least one complete reciprocation of said tooth for each one rotation of said drum about said axis.

4. A device as in claim 1 including a second drum, means for mounting said second drum on said boom for rotation relative thereto about said horizontal axis and with said boom between said drum and said second drum, a second mobile tooth, means for mounting said second mobile tooth on said second drum for reciprocation in a second path parallel to said horizontal axis, and means for reciprocating said second mobile tooth in said second path between a projected position extending beyond said second drum and a retracted position proximate said drum and out of phase with said reciprocation of said mobile tooth.

5. A device as in claim 1 including a plurality of fixed teeth mounted on the periphery of said drum and spaced from said mobile tooth.

6. A device as in claim 1 including an arcuate shroud, and means for mounting said shroud on said support to extend around said drum concentrically with said axis.

7. A pavement slot cutter comprising a support, a boom on said support and extending therefrom in a predetermined direction, a drum having an end, means for mounting said drum on said boom for rotation relative thereto about a horizontal axis extending normal to said predetermined direction, a mobile tooth, means for mounting said mobile tooth on said drum for reciprocation in a path parallel to said axis, and means for reciprocating said mobile tooth in said path between a projected position, beyond said end of said drum when said tooth is in a rotary position remote from said boom, and a retracted position, proximate said end of said drum when said tooth is in a rotary position adjacent said boom.

8. A pavement slot cutter comprising a support, a boom on said support and extending therefrom in a predetermined direction, a drum having an inner end and an outer end, means for mounting said drum on said boom for rotation relative thereto about a horizontal axis extending normal to said predetermined direction, a mobile tooth, means for mounting said mobile tooth on said drum for reciprocation in a path parallel to said axis, means for reciprocating said mobile tooth in said path between a projected position beyond said end of said drum and a retracted position proximate said inner end of said drum, and an arcuate shroud mounted on said boom to extend partially around said drum and to stop short of said outer end of said drum.

* * * * *